US006745741B2

(12) United States Patent
Liu

(10) Patent No.: US 6,745,741 B2
(45) Date of Patent: Jun. 8, 2004

(54) COOLING SYSTEM FOR FOUR-STROKE CYCLE INTERNAL COMBUSTION ENGINE

(75) Inventor: Yumin Liu, Fussa (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/245,360

(22) Filed: Sep. 18, 2002

(65) Prior Publication Data

US 2003/0051697 A1 Mar. 20, 2003

(30) Foreign Application Priority Data

Sep. 18, 2001 (JP) ..... 2001-283087

(51) Int. Cl.[7] ..... F01M 1/00
(52) U.S. Cl. ..... 123/196 R
(58) Field of Search ..... 123/196 R, 41.69, 123/41.32

(56) References Cited

U.S. PATENT DOCUMENTS 5,421,292 A 6/1995 Hoffman et al.
6,394,060 B2 * 5/2002 Nagai et al. ..... 123/196 R

FOREIGN PATENT DOCUMENTS

JP 3168140 B2 3/2001

* cited by examiner

*Primary Examiner*—Henry C. Yuen
*Assistant Examiner*—Katrina B. Harris
(74) *Attorney, Agent, or Firm*—Nixon Peabody LLP; Donald R. Studebaker

(57) ABSTRACT

A cooling system for an OHC type four-stroke cycle internal combustion engine having a valve chamber lubricated by oil mist. The system includes an accommodating space accommodating a transmission mechanism, a blower fan rotatably driven by a crankshaft, and a cooling air channel extending between a combustion chamber and the valve chamber disposed above the combustion chamber. The cooling air channel includes a primary air channel formed between intake and exhaust ports and extends toward a spark plug located on the downstream side of the cooling air channel. The cooling air channel also includes an air guide channel for guiding the air to an upstream inlet of the primary air channel and is defined by a wall which faces the upstream inlet of the primary air channel and extends laterally. The wall extends vertically in the accommodating space and is formed with an oil mist passage extending vertically therein.

15 Claims, 3 Drawing Sheets

COOLING SYSTEM FOR FOUR-STROKE CYCLE INTERNAL COMBUSTION ENGINE

BACKGROUND OF THE INVENTION

1. Field of the Invention

The present invention relates to a cooling system for four-stroke cycle internal combustion engines, and more particularly to a cooling system for cooling a cylinder head portion of a four-stroke cycle internal combustion engine.

2. Description of the Related Art

An air cooling type four-stroke cycle internal combustion engine used in a portable trimmer, a chain saw or the like is subject to overheating around the combustion chamber or spark plug. There have been known various engine cooling systems for preventing such overheating. For example, Japanese Patent No. 3168140 discloses an engine cooling system in which an engine body having a spark plug screwed in the top wall of each cylinder is covered by a shroud to define a cooling air channel between the engine body and the shroud, and a rotor having a cooling blade is fixed to the outer end of a crankshaft supported by the engine body, so that the cooling blade is rotated by the crankshaft to generate a cooling airstream in the cooling air channel. In this cooling system, the engine body is also formed with a primary air channel for leading the cooling air from the cooling air channel through a valve chamber in the engine body and the space between intake, and exhaust ports in the engine body toward the spark plug, and an auxiliary air guide channel intersecting the primary air channel to allow the cooling air introduced from the cooling air channel through inlets at both ends of the primary air channel to be led to the primary air channel. Such a cooling system can prevent overheating from occurring around the combustion chamber or spark plug.

Another known four-stroke cycle internal combustion engine is one in which a lubricating oil reserved in an oil reservoir chamber is atomized to form an oil mist and a valve mechanism in a valve chamber is lubricated by the oil mist. In this type of four-stroke cycle internal combustion engine, overheating of the oil mist leads to insufficient lubrication and excessively increased oil consumption.

SUMMARY OF THE INVENTION

It is therefore an object of the present invention to provide a four-stroke cycle internal combustion engine cooling system capable of preventing overheating of oil mist for lubrication, particularly for an OHC type four-stroke cycle internal combustion engine in which the oil mist flowing around a valve chamber is apt to receive excessive heat because the valve chamber is located above a combustion camber.

In order to achieve the above object, according to the present invention, there is provided a cooling system for a four-stroke cycle internal combustion engine in which a lubricating oil reserved in an oil reservoir chamber is atomized to generate an oil mist and a valve chamber is lubricated thereby. This cooling system comprises an accommodating space which accommodates a transmission mechanism for transmitting the rotational movement of a crankshaft to a camshaft in the valve chamber and extends vertically along the side of a cylinder block, a blower fan rotatably driven by the crankshaft to send an air upward through the accommodating space, and a cooling air channel extending laterally between a combustion chamber in the cylinder block and the valve chamber disposed above the combustion chamber to receive the air from the accommodating space. The cooling air channel includes a primary air channel formed between intake and exhaust ports extending laterally in respective opposite directions. The primary air channel extends toward a spark plug located on the downstream side of the cooling air channel. The cooling air channel also includes an air guide channel for guiding the air from a pair of air inlets opposed to one another to an upstream inlet of the primary air channel. The air guide channel is defined by a wall which faces the upstream inlet of the primary air channel and extends laterally along the intake and exhaust ports. The wall extends vertically in the accommodating space. Further, the wall is formed with an oil mist passage extending vertically therein to supply the oil mist from the oil reservoir chamber to the valve chamber.

In the present invention, when the blower fan is rotated by the rotation of the crankshaft, the generated airstream reaches the primary air channel through the accommodating space and the opposed air inlets of the air guide channel.

According to the present invention, the vicinity of the spark plug is cooled by the air from the cooling air channel. Since the cooling air channel is disposed between the valve chamber and the spark plug, the valve chamber hardly receives any heat from the vicinity of the spark plug. The bottom wall of the valve chamber is also cooled by the air flowing through the cooling air channel. Thus, the valve chamber is prevented from being excessively heated. Further, since the oil mist passage is formed in the wall extending vertically in the accommodating space, the oil mist flowing through the oil mist passage is cooled by the airstream in the accommodating space. In this manner, the valve chamber and the oil mist passage are adequately cooled. This prevents insufficient lubrication and excessive oil consumption.

In one embodiment of the present invention, the cylinder block may be formed with a plurality of air-cooling fins extending outward from the periphery of the cylinder block. In this case, the wall having the oil mist passage extends vertically through the plurality of air-cooling fins.

In another embodiment of the present invention, the wall may have a laterally extended cross-section, and the oil mist passage may comprise a pair of circulation passages extending vertically in respective side portions of the wall. In this case, the circulation passages are in fluid communication with the oil reservoir chamber and the valve chamber to allow the oil mist to be circulated from the oil reservoir chamber to the valve chamber and from the valve chamber to the oil reservoir chamber. Each of the circular passages has a substantially circular cross-section, and each periphery of the side portions of the wall is curved along the cross-sectional shape of the corresponding circular passage to enlarge the corresponding air inlet of the air guide channel in cross-section.

In still another embodiment of the present invention, the wall may include a concave portion provided in its surface facing to the accommodating space between the circulation passages so that the wall has a substantially C-shaped cross-section opened toward the accommodating space.

In yet another embodiment of the present invention, the primary air channel and the air guide channel having the pair of opposed air inlets may be combined to form a substantially T-shaped cooling air channel or a substantially Y-shaped cooling air channel.

Other features and advantages of the present invention will be apparent from the accompanying drawings and from the detailed description.

DESCRIPTION OF THE PREFERRED EMBODIMENT

With reference to the drawings, a four-stroke cycle internal combustion engine according to an embodiment of the present invention will now be described.

Figure 1:
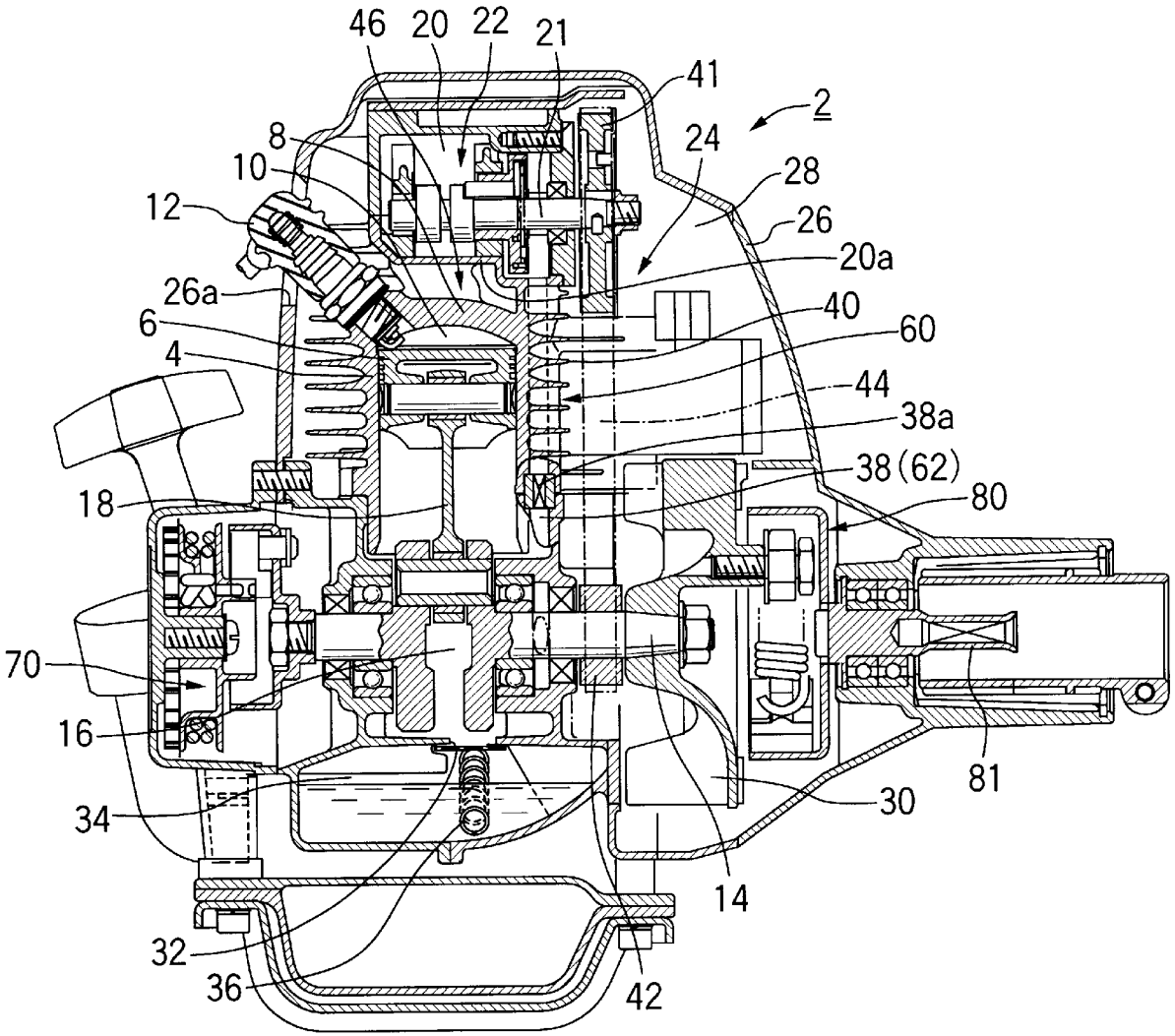
FIG. 1 is a vertical cross-sectional view showing an OHC type air cooling type four-stroke cycle internal combustion engine according one embodiment of the present invention.
Figure 2:
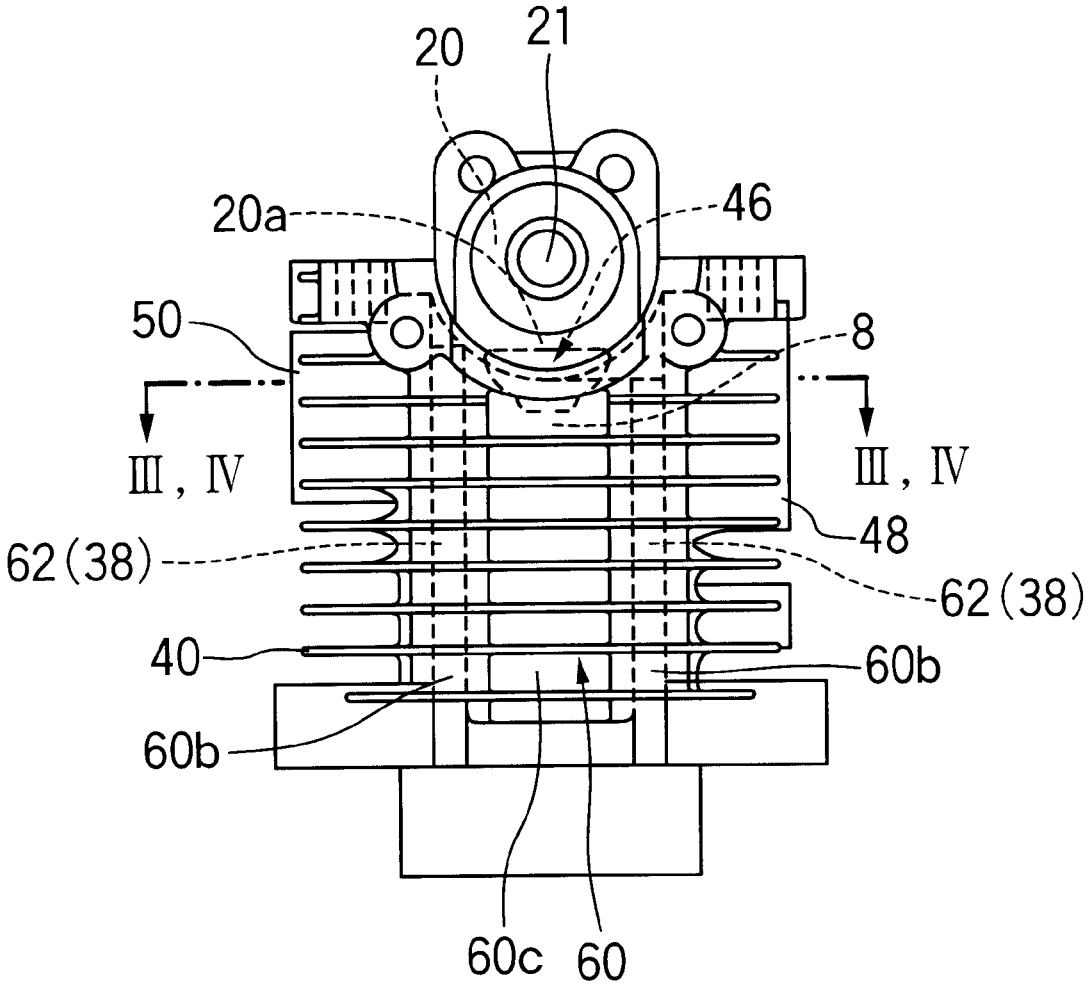
FIG. 2 is an enlarged fragmentary view of a cylinder block and a valve mechanism in the four-stroke cycle internal combustion engine shown in FIG. 1.

As shown in FIG. 1, the four-stroke cycle internal combustion engine 2 according to this embodiment includes a piston 6 operable to move upward and downward in a cylinder block 4, a combustion chamber 10 disposed above the piston 6 and defined by the inner surface of a cylinder head 8 which is an upper part of the cylinder block 4 and the upper surface of the piston 6. A spark plug 12 is provided in the cylinder head 8 above the piston 6. A connecting rod 18 connects the piston 6 and a crankshaft 14. A valve chamber 20 is provided in the cylinder head 8 above the combustion chamber 10, and a valve mechanism (cams, rocker arms and others) is contained in the valve chamber 20. A transmission mechanism 24 transmits the rotation of the crankshaft 14 to a camshaft of the valve mechanism 22. An accommodating space 28 is formed in the longitudinal (vertical) direction of the cylinder block 4 by covering the cylinder block 4 with a housing 26, so as to accommodate the transmission mechanism 24. A blower fan 30 is disposed at the lower portion of the accommodating space 28 and attached to the crankshaft 14, with a crank chamber accommodating the crankshaft 14. An oil reservoir chamber 34 is in fluid communication with the crank chamber 16 through a slit 32 and capable of reserving lubricating oil therein. An atomizing device 36 for atomizing the oil reserved in the oil reservoir chamber 34 is provided therein to generate an oil mist. An oil mist passage 38 for supplying the oil mist, which is atomized by the atomizing device 36 in the oil reservoir chamber 34 and moved in the crank chamber, communicates with the valve chamber 20. As shown in FIGS. 1 and 2, the cylinder block 4 is formed with a plurality of air-cooling fins 40 each extending from the outer periphery thereof in the radially outward direction of the bore of the cylinder block 4.

The atomizing devise 36 may be comprised of any suitable device capable of atomizing oil to generate oil mist, such as a coil spring hanging down into the oil reservoir 34 in the form of a U-shape with the lower portion thereof immersed into oil in the oil reservoir 34, or an oil dipper.

The transmission mechanism 24 comprises a drive pulley 42 attached to the crankshaft 14, a driven pulley 41 attached to the camshaft 21, and a timing belt 44 wound around the drive pulley 42 and the driven pulley 41.

The reference numeral 70 in FIG. 1 indicates a recoil starter for a starting operation. After start-up of the internal combustion engine 2, a rotational driving force is provided from a PTO shaft 81 to a trimmer (not shown) or the like through a centrifugal clutch 80.

Figure 3:
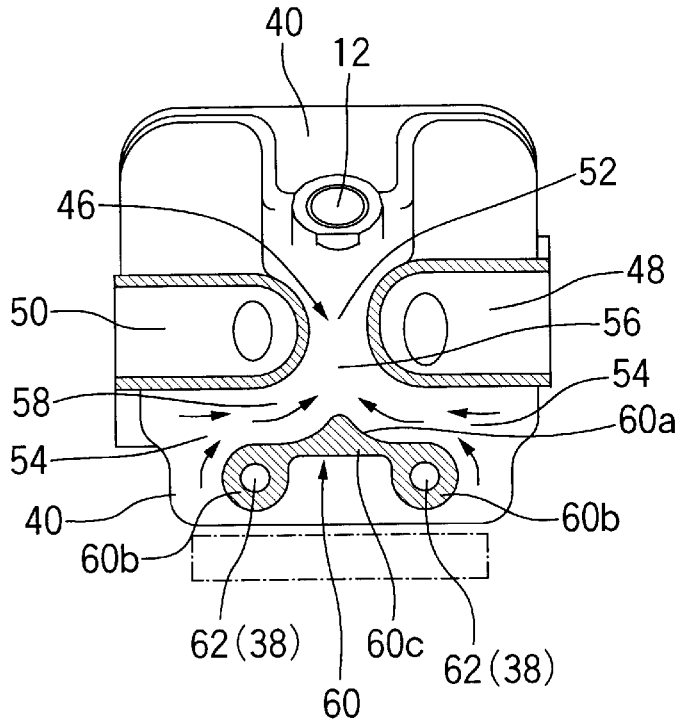
FIG. 3 is a cross-sectional view showing a cooling air channel taken along the line III—III of FIG. 2.

As can been seen from FIG. 2, a cooling air channel 46 is provided between the combustion chamber 10 and the valve chamber 20 disposed above the combustion chamber 10. The cooling air channel 46 extends laterally or perpendicular to the moving direction of the piston 6 or the longitudinal direction of the cylinder block 4. More specifically, as shown in FIG. 3, the cooling air channel 46 includes a primary air channel 52 formed between an intake port 48 and an exhaust port 50 which extend laterally in respective opposite directions. The primary air channel 52 extends toward the spark plug 12 located on the downstream side of the cooling air channel. The cooling air channel 46 also includes an air guide channel 58 having a pair of air inlets opposed to one another to introduce an air stream in the accommodating space 28. The air guide channel 58 acts to guide the air from the air inlets to an upstream inlet 56 of the primary air channel 52. The air guide channel 58 is defined by a laterally extended wall 60 which faces the upstream inlet 56 of the primary air channel 52 and extends laterally along the intake port 48 and the exhaust port 50. The wall 60 extends vertically in the accommodating space 28. In the cooling air channel 46, the primary air channel 52 and the air guide channel 58 combine together to form a Y-shaped channel. As shown in FIG. 2, the upper wall of the cooling air channel 46 is composed of the bottom wall 20*a* of the valve chamber 20. The surface 60*a* of the wall 60 facing air guide channel 58 has a chevron-shaped cross-section projecting into the upstream inlet 56 of the primary air channel 52. Further, each surface on both sides of the tip of the chevron-shaped projection is curved toward the upstream inlet 56 to allow the airstream to be smoothly guided to the upstream inlet 56.

Referring again to FIG. 1, the wall 60 extends vertically in the accommodating space 28. The oil mist passage 38 extends vertically through the wall 60 up to the valve chamber 20. As can be seem from FIG. 3, two of the oil mist passages 38 are formed in both side portions of the wall 60, shown in cross-section. Each of the oil mist passages 38 extends vertically through the wall 60 to provide fluid communication between the oil reservoir chamber 34 and the valve chamber 20 to form a circulation passage 62. While not diagrammatically shown, each of the circulation passages 62 is provided with a check valve 38*a* to allow the oil mist to be circulated between the oil reservoir chamber 34 and the valve chamber 20 in response to positive and negative pressures in the crank chamber 16 caused by the upward and downward movements of the piston 6. Each of the two oil mist passages 38 has a substantially circular cross-section, and each periphery of the side portions 60*b* of the wall 60 is curved along the cross-sectionally circular shape of the corresponding oil mist passage 38 to enlarge the corresponding air inlet 54 of the air guide channel 58. Further, as shown in FIG. 3, the wall 60 cross-sectionally includes a concave portion 60*c* provided in its surface facing the accommodating space 28 between the oil mist passages 38 so that the wall 60 has a substantially C-shaped cross-section generally opened toward the accommodating space 28. This provides an increased area of the outer peripheral surface of the wall (or area for heat-exchanging) around the circulation passages 62. Further, as can be seen from FIGS. 1 and 2, in the outer periphery of the cylinder block 4, the wall 60 having the oil mist passage 38 is integrally formed with the plurality of air-cooling fins 40 to extend vertically through the plurality of air-cooling fins 40.

A vent hole 26*a* is formed in the upper portion of the housing 26 on the downstream side of the airstream to allow the air from the cooling air channel 46 to flow out of the housing 26*a* through the vent hole 26*a*.

Figure 4:
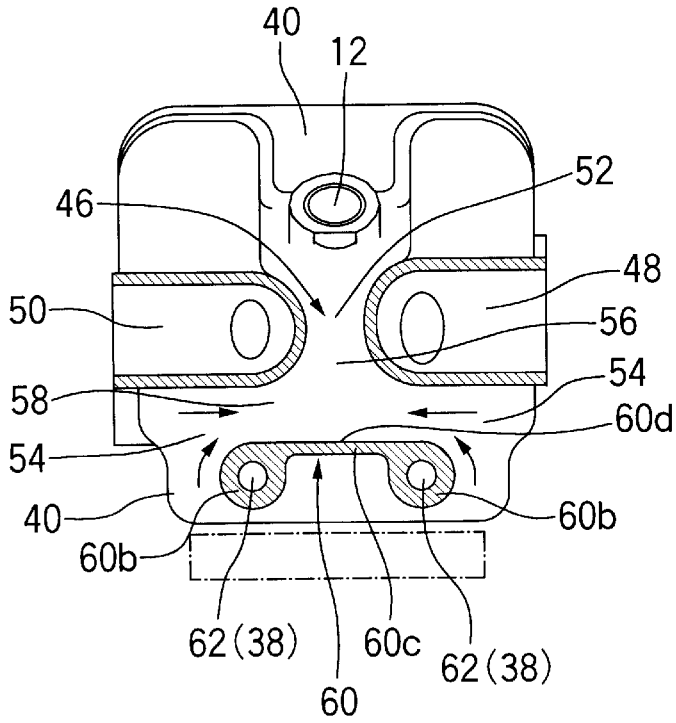
FIG. 4 is a cross-sectional view showing a modified embodiment of the cooling air channel shown in FIG. 3.

FIG. 4 shows a modified embodiment of the cooling air channel shown in FIG. 3. To minimize repeatative description, the same elements or components as those in FIG. 3 are indicated by the same reference numerals, and additional descriptions will be omitted. Only different structure from that of FIG. 3 will be described below.

In the embodiment shown in FIG. 3, the surface 60*a* of the wall 60 facing the air guide channel 58 is formed as a chevron-shaped projection. On the other hand, the modified embodiment shown in FIG. 4 is different from the embodiment of FIG. 3 in that the surface 60*d* of the wall 60 facing the air guide channel 58 is flat, and the air guide channel 58 and the primary air channel 58 are combined to form a substantially T-shaped cooling air channel 46.

The cooling system shown in FIGS. 1 to 4 operates as follows.

When the four-stroke cycle internal combustion engine 2 is activated by the recoil starter 70, the crankshaft 14 is rotated by the upward and downward movements of the piston 6 through the connecting rod 18. The drive pulley 42 is rotated in response to the rotation of the crankshaft 14, and the driven pulley 41 is rotated through the timing belt 44 and the valve mechanism 22 in the valve chamber 20 is operated. The atonomizing device or coil spring 36 in the oil reservoir 34 is vibrated due to the vibration of the four-stroke cycle internal combustion engine 2 and the swinging of the four-stroke cycle internal combustion engine 2 occurs in a usual work operation, and whereby the oil is splattered by the vibration of the coil spring to atomize the oil so as to generate the oil mist. The generateed oil mist is supplied from the oil reservoir chamber 34 through the crank chamber 16 and the oil mist passage to the valve chamber 20 in response to the positive and negative pressures in the crank chamber 16 caused by the upward and downward movements of the piston 6. More specifically, the oil mist is supplied from crank chamber 16 to the valve chamber 20 through one of the two oil mist passages 38 forming the circulation passages 62, and the oil mist in the valve chamber 20 is returned to the crank chamber 16 through the other circulation passage 62. This circulation is assured by the check valves 38*a* provided in the circulation passages 62.

The blower fan 30 is rotated by the rotation of the crankshaft 14. The airstream generated by the blower fan 30 is directed upward through the accommodating space 28 accommodating the transmission mechanism 24. Then, the airstream is introduced into the pair of opposed air inlets of the air guide channel 58 of the cooling air channel 46. The introduced air flows through the air guide channel, and then comes together at the upstream inlet 56 of the primary air channel 52. The combined airstream enters into the upstream inlet 56, and passes through the primary air channel 53. The air finally flows out of the housing 26 through the vent hole 26*a* formed in the housing 26.

When the air flows through the accommodating space 28, the air cools down the wall 60 extending in the longitudinal direction of the cylinder block to cool down the oil mist in the oil mist passages 38 extending through the wall 60. Further, the air flowing through the cooling air channel effectively cools down the vicinity of the spark plug 12 and the interior of the valve chamber 20.

According to this embodiment, the cooling air channel 46 disposed between the spark plug 12 and the valve chamber 20 acts to suppress the heat transfer from the spark plug 12 to the valve chamber 20. Further, the air flowing through the cooling air channel 46 absorbs heat from the bottom wall of the valve chamber 20 making up the upper wall of the cooling air channel 46 to cool down the valve chamber 20. Thus, the oil mist in the valve chamber 20 is cooled so as to prevent overheating of the oil and excessive oil consumption.

In this embodiment, the wall 60 extends vertically in the accommodating space 28, and the oil mist passages 38 extend vertically in the wall 60 up to the valve chamber 20. Thus, the wall 60 is cooled when the air flows in the accommodating space 28, and whereby the oil mist in the oil mist passages 38 is also cooled. This can effectively facilitate the prevention insufficient lubrication in the valve chamber 20 and excessive oil consumption.

This embodiment can also provide an enhanced cooling effect because the wall 60 having the oil mist passages 38 extends vertically through the plurality of cooling fins 40. This prevents the oil mist flowing in the oil mist passes from being excessively heated and consumed.

Two of the oil mist passage 38 are cross-sectionally formed in both side portions of the wall 60, respectively. Further, each periphery of the side portions of the wall 60 is curved along the cross-sectional shape of the corresponding oil mist passage to enlarge the corresponding air inlet 54 of the air guide channel 58 in cross-section. Thus, the oil mist is cooled during the circulation in the oil mist passages 38. The enlarged air inlets 54 allow for an increased amount of air introduced into the cooling air channel, achieving an enhanced cooling effect for the spark plug 12 and the valve chamber 20. Further, the oil mist passages 38 disposed adjacent to the air inlets 54 can provide enhanced oil mist cooling effect.

In this embodiment, the wall 60 along its cross-section includes the concave portion 60*c* between the oil mist passages 38 so that the wall has a substantially C-shaped cross-section generally opened toward the accommodating space 28. This provides an increased cooling area of the wall 60 around the oil mist passages 38, and an enhanced cooling effect for the oil mist flowing in the circulation passages 62.

If required, a cooling fin may be provided on the back of the driven pulley 41 to facilitate cooling of the circulation passages 62.

Further, in this embodiment, the cooling air channel 46 is formed as a substantially Y-shaped or T-shaped passage. Thus, the air introduced through the opposed air inlets 54 of the air guide channel 58 is smoothly guided to the upstream inlet 56 of the primary air channel 52. This provides for an increased amount of air to be introduced into the cooling air channel.

Moreover, the stiffness of the entire structure including the cylinder block 4 and the valve chamber is effectively increased by the wall 60.

It is to be understood that the present invention is not limited to the above embodiments, and various modified embodiments can be made without departing from the sprit and scope of the present invention defined only by the appended claims. Such modified embodiments are encompassed within the scope of the present invention.

For example, while the cooling air channel 46 of this embodiment has a substantially Y-shape or T-shape, the shape of the channel is not limited to a particular shape because the valve chamber 20 can be cooled only by providing the cooling air channel 46 between the combustion chamber 10 and the valve chamber 20.

Further, while this embodiment includes two oil mist passages 38 to form the circulation passage 62, only one oil mist passage 38 need be provided. In this case, the check valves 38*a* are omitted to allow the oil mist to flow bi-directionally between the oil chamber 34 and the valve chamber 20 through a common oil mist passage, in response to positive and negative pressures in the crank chamber 16.

As described above, the present invention can provide a four-stroke cycle internal combustion engine cooling system capable of preventing overheating of oil mist for lubrication, particularly in an OHC type four-stroke cycle internal combustion engine in which the oil mist flowing around a valve chamber is apt to receive excessive heat because the valve chamber is located above a combustion chamber.

What is claimed is:

1. A cooling system for a four-stroke cycle internal combustion engine including an oil reservoir chamber for accommodating a lubricating oil which is atomized to generate an oil mist, a cylinder block having an accommodating space extending vertically along the side thereof, a combustion chamber provided in the cylinder block, a valve chamber disposed above the combustion chamber and being lubricated by the oil mist, a spark plug, a crankshaft, a camshaft in the valve chamber, a transmission mechanism for transmitting rotational movements of the crankshaft to the camshaft and accommodated in the accommodating space, a blower fan which is rotatably driven by the crankshaft to send air upward through the accommodating space, and intake and exhaust ports formed in the cylinder block and each having a horizontal portion and a vertical portion that extends laterally in respective opposite directions, said cooling system comprising:

a cooling air channel extending laterally between the combustion chamber and the valve chamber and through which air from the accommodating space flows, said cooling air channel having a primary air channel formed between the vertical portions of the respective intake and exhaust ports and extending toward the spark plug, and an air guide channel having a pair of air inlets opposed to one another and for guiding the air from said pair of air inlets to an upstream inlet of said primary air channel, said air guide channel being defined by a wall extending laterally along the horizontal portions of the respective intake and exhaust ports and across said upstream inlet of said primary air channel, said wall extending vertically in the accommodating space and including an oil mist passage communicated with the oil reservoir chamber and extending vertically therein to supply the oil mist from the oil reservoir chamber to the valve chamber.

2. A cooling system as defined in claim 1, wherein the cylinder block is formed with a plurality of air-cooling fins extending outward from the periphery of the cylinder block, wherein said wall having said oil mist passage extends vertically through said plurality of air-cooling fins.

3. A cooling system as defined in claim 1, wherein said wall has a laterally extended cross-section, wherein said oil mist passage comprises a pair of circulation passages extending vertically in respective side portions of said wall, said circulation passages being in fluid communication with the oil reservoir chamber and the valve chamber to allow the oil mist to be circulated from the oil reservoir chamber to the valve chamber and from the valve chamber to the oil reservoir chamber respectively, said circularation passages each having a substantially circular cross-section, each periphery of said side portions of said wall being curved along the cross-section of said corresponding circular passage to enlarge said corresponding air inlet of said air guide channel in cross-section.

4. A cooling system as defined in claim 2, wherein said wall has a laterally extended cross-section, wherein said oil mist passage comprises a pair of circulation passages extending vertically in respective side portions of said wall, said circulation passages being in fluid communication with the oil reservoir chamber and the valve chamber to allow the oil mist to be circulated from the oil reservoir chamber to the valve chamber and from the valve chamber to the oil reservoir chamber respectively, said circulation passages each having a substantially circular cross-section, each periphery of said side portions of said wall being curved along the cross-section of said corresponding circular passage to enlarge said corresponding air inlet of said air guide channel in cross-section.

5. A cooling system as defined in claim 1, wherein said wall includes a concave portion provided in its surface facing the accommodating space between said circulation passages so that said wall has a substantially C-shaped cross-section opened toward the accommodating space.

6. A cooling system as defined in claim 2, wherein said wall includes a concave portion provided in its surface facing the accommodating space between said circulation passages so that said wall has a substantially C-shaped cross-section opened toward the accommodating space.

7. A cooling system as defined in claim 3, wherein said wall includes a concave portion provided in its surface facing the accommodating space between said circulation passages so that said wall has a substantially C-shaped cross-section opened toward the accommodating space.

8. A cooling system as defined in claim 4, wherein said wall includes a concave portion provided in its surface facing the accommodating space between said circulation passages so that said wall has a substantially C-shaped cross-section opened toward the accommodating space.

9. A cooling system as defined in claim 1, wherein said primary air channel and said air guide channel having said pair of opposed air inlets together form a substantially T-shaped cooling air channel or a substantially Y-shaped cooling air channel.

10. A cooling system as defined in claim 2, wherein said primary air channel and said air guide channel having said pair of opposed air inlets together form a substantially T-shaped cooling air channel.

11. A cooling system as defined in claim 2, wherein said primary air channel and said air guide channel having said pair of opposed air inlets together form a substantially Y-shaped cooling air channel.

12. A cooling system as defined in claim 3, wherein said primary air channel and said air guide channel having said pair of opposed air inlets together form a substantially T-shaped cooling air channel.

13. A cooling system as defined in claim 3, wherein said air guide channel having said pair of opposed air inlets together form a substantially Y-shaped cooling air channel.

14. A cooling system as defined in claim 4, wherein said air guide channel having said pair of opposed air inlets together form a substantially T-shaped cooling air channel.

15. A cooling system as defined in claim 4, wherein said air guide channel having said pair of opposed air inlets together form a substantially Y-shaped cooling air channel.

* * * * *